US008295751B2

(12) United States Patent
Souda et al.

(10) Patent No.: US 8,295,751 B2
(45) Date of Patent: Oct. 23, 2012

(54) THERMAL FIXING UNIT HAVING PIVOTALLY MOVABLE PRESSURE PAD AND IMAGE FORMING DEVICE PROVIDED WITH THE SAME

(75) Inventors: Makoto Souda, Nagoya (JP); Kazuna Taguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 659 days.

(21) Appl. No.: 12/396,682

(22) Filed: Mar. 3, 2009

(65) Prior Publication Data

US 2009/0245901 A1 Oct. 1, 2009

(30) Foreign Application Priority Data

Mar. 27, 2008 (JP) ..... 2008-084531

(51) Int. Cl.
*G03G 15/20* (2006.01)

(52) U.S. Cl. ..... 399/329

(58) Field of Classification Search ..... 399/122, 399/328–331; 219/216, 619
See application file for complete search history.

(56) References Cited

U.S. PATENT DOCUMENTS 4,145,181 A * 3/1979 Edwards et al. ..... 432/60
5,999,788 A 12/1999 Kanesawa et al.
7,764,913 B2 * 7/2010 Tsunoda ..... 399/329
7,890,038 B2 * 2/2011 Chikugo et al. ..... 399/323
2009/0196663 A1 8/2009 Yasumaru et al.

FOREIGN PATENT DOCUMENTS

| | | |
|---|---|---|
| JP | 10-307493 | 11/1998 |
| JP | 11133776 A | 5/1999 |
| JP | 2000-056530 | 2/2000 |
| JP | 2003-005553 | 1/2003 |
| JP | 2004077871 A | 3/2004 |
| JP | 2004-233837 | 8/2004 |
| JP | 2007-156455 | 6/2007 |
| JP | 2007-322907 | 12/2007 |
| JP | 2008064934 A | 3/2008 |

OTHER PUBLICATIONS

Office Action received for Japanese Application 2008-084531 mailed Jul. 6, 2010.
Office Action for Japanese patent application No. 2008-084531 mailed Feb. 15, 2011.
Office action for Japanese patent application No. 2011-173636 mailed Oct. 11, 2011.

* cited by examiner

*Primary Examiner* — Hoan Tran
(74) *Attorney, Agent, or Firm* — Banner & Witcoff, Ltd.

(57) ABSTRACT

There is provided a thermal fixing unit that fixes a toner image on a printing medium, the fixing unit including a heat member, a pressure pad, a movable supporting assembly, and an urging member. The heat member is in contact with the printing medium, being positionally fixed and defining an axis. The pressure pad is disposed in opposition to the heat member for nipping the printing medium in cooperation with the heat member. The supporting assembly pivotably movably supports the pressure pad. The urging member biases the supporting assembly to urge the pressure pad toward the heat member for providing pressure contact between the heat member and the pressure pad.

10 Claims, 6 Drawing Sheets

THERMAL FIXING UNIT HAVING PIVOTALLY MOVABLE PRESSURE PAD AND IMAGE FORMING DEVICE PROVIDED WITH THE SAME

CROSS REFERENCE TO RELATED APPLICATION

This application claims priority from Japanese Patent Application No. 2008-084531 filed Mar. 27, 2008. The entire content of the priority application is incorporated herein by reference in its entirety.

TECHNICAL FIELD

The present invention relates to an image forming device such as a laser printer, and also to a thermal fixing unit provided in the image forming device.

BACKGROUND

A conventional image forming device is provided with a fixing unit that fixes a toner image transferred from a photosensitive unit onto a sheet of paper.

One of such conventional fixing units includes a heat roller, a pressure pad disposed in opposition to the heat roller, and a fixing belt interposed between the heat roller and the pressure pad.

In this fixing unit, the fixing belt can press the heat roller with a large contact area by the pressure applied from the pressure pad, facilitating efficient fixation of toner images. But, at the same time, the pressure pad is required to be in close contact with the heat roller via the fixing belt.

To this effect, laid-open Japanese patent application publication No. 2003-5553 discloses a fixing unit including a heat roller, an endless fixing belt, and a pressure member disposed inside the endless belt. The pressure member is provided with a nip head member for pressing the belt against the surface of the heat roller. The pressure member is attached to an arm member via a belt guide member, and the arm member has one end portion serving as a pivot portion for pivotal movement of the arm member. The nip head member presses the endless belt in a direction toward the vicinity of the center of the heat roller.

In the above-described configuration, since the pressure member is fixed to the arm member, accurate positioning of the pressure member relative to the heat roller at the time of assembly is required so that the nip head member can be in close contact with the heat roller irrespective of the pivotal movement of the arm member. However, demand for such high positioning accuracy necessitates less product tolerance and leads to time-consuming assembly.

In view of the forgoing, it is an object of the present invention to provide a heat fixing unit with a simple structure capable of achieving close contact between a pressure pad and a heat roller, and to provide an image forming device including such a heat fixing unit.

SUMMARY

In order to achieve the above and other objects, the present invention provides a heat fixing unit that fixes a toner image on a printing medium. The fixing unit includes a heat member, a pressure pad, a movable supporting assembly, and an urging member. The heat member is in contact with the printing medium, being positionally fixed and defining an axis. The pressure pad is disposed in opposition to the heat member for nipping the printing medium in cooperation with the heat member. The supporting assembly pivotably movably supports the pressure pad. The urging member biases the supporting assembly to urge the pressure pad toward the heat member for providing pressure contact between the heat member and the pressure pad.

According to another aspect of the present invention, there is provided an image forming device having a thermal fixing unit for fixing a toner image on a printing medium. The fixing unit includes a heat member, a pressure pad, a movable supporting assembly, and an urging member. The heat member is in contact with the printing medium, being positionally fixed and defining an axis. The pressure pad is disposed in opposition to the heat member for nipping the printing medium in cooperation with the heat member. The supporting assembly pivotably movably supports the pressure pad. The urging member biases the supporting assembly to urge the pressure pad toward the heat member for providing pressure contact between the heat member and the pressure pad.

BRIEF DESCRIPTION OF THE DRAWINGS

The particular features and advantages of the invention as well as other objects will become apparent from the following description taken in connection with the accompanying drawings, in which:

FIG. 5 is a view explaining how a pressure pad is pressed against a heat roller, wherein

DETAILED DESCRIPTION

An image forming device provided with a fixing unit according to a first embodiment of the present invention will be described with reference to FIGS. 1 to 5B.

Figure 1:
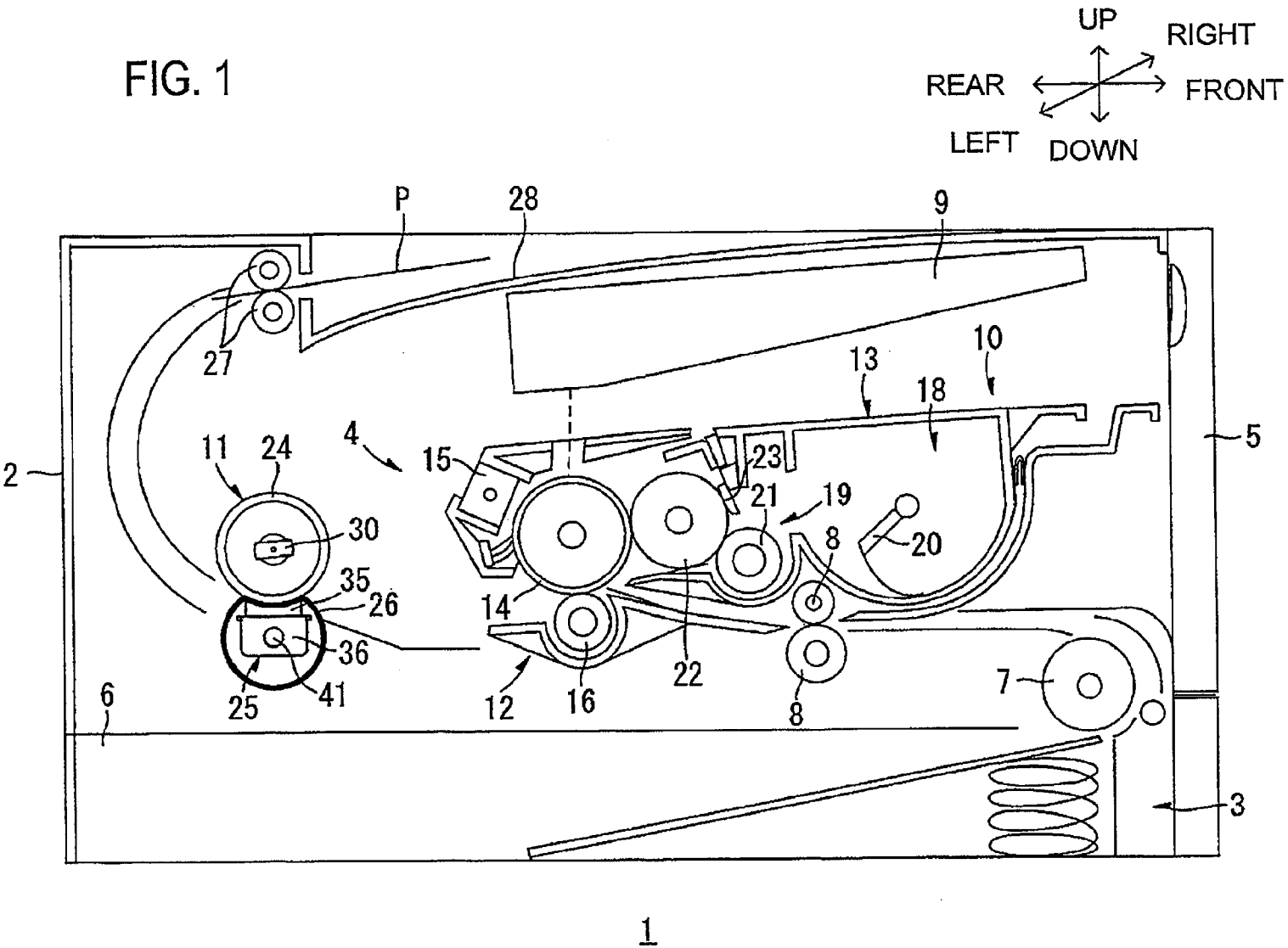
FIG. 1 is a schematic cross-sectional view taken along a widthwise central line of a laser printer including a fixing unit according to a first embodiment of the image forming device of the present invention.

In FIG. 1, a laser printer 1 has a main casing 3 in which a feeder unit 3 and an image forming unit 4 are provided. A front cover 5 is provided in one of the sidewalls of the main casing 2 so as to be opened or closed for detachably mounting a process cartridge 10.

Note that, hereinafter, the right side of the laser printer 1 in FIG. 1 (the side of the main casing 2 in which a front cover 5 is provided) will be referred to as a "front side," while the left side of the laser printer 1 in FIG. 1 will be referred to as a "rear side." Further, the left and right sides of the laser printer 1 will be defined based on a state where the laser printer 1 is seen from the front side thereof.

The feeder unit 3 includes a sheet tray 6 that accommodates sheets of paper P (hereinafter simply referred to as 'sheet P') in a stacked state. Here, the sheet P is merely used as an example of objects on which toner images are fixed. The sheet tray 6 is detachably mounted in the bottom portion of the main casing 2. A sheet supply roller 7 is disposed above the front end portion of the sheet tray 6, and a pair of registration rollers 8 is disposed rearward of the sheet supply roller 7.

The sheet supply roller 7 rotates and conveys the sheets P accommodated in the sheet tray 6 one sheet at a time toward the registration rollers 8. The registration rollers 8 then convey the sheet P toward the image forming unit 4, specifically between a photosensitive drum 14 and a transfer roller 16.

The image forming unit 4 includes a scanner unit 9, a process cartridge 10 and a thermal fixing unit 11.

The scanner unit 9 is disposed in the upper portion of the main casing 2. The scanner unit 9 emits a laser beam toward the photosensitive drum 14 of the process cartridge 10 based on image data to be formed, as shown by a broken line in FIG. 1.

The process cartridge 10 is disposed below the scanner unit 9. The process cartridge 10 includes a drum cartridge 12, and a developing cartridge 13 detachably mounted in the drum cartridge 12.

A photosensitive drum 14 is rotatably provided in the drum cartridge 12. A Scorotron charger 15 and a transfer roller 16 are disposed around the photosensitive drum 14.

The developing cartridge 13 defines therein a toner accommodating chamber 18 and a developing chamber 19 formed next to the accommodating chamber 18 in the front-to-rear direction. The toner accommodating chamber 18 and the developing chamber 19 are interconnected therebetween.

The toner accommodating chamber 18 accommodates nonmagnetic, single-component polymerized toner having a positive charge. An agitator 20 is provided in the toner accommodating chamber 18.

The developing chamber 19 is provided with a supply roller 21, a developing roller 22 and a thickness-regulating blade 23. The developing roller 22 is disposed rearward of the supply roller 21 so as to be in contact with the supply roller 21 while pressing the same from rearward. The thickness-regulating blade 23 has a base end fixed to the developing chamber 19 and a free end disposed so as to be pressed against a circumferential surface of the developing roller 22 from diagonally above.

As the agitator 20 agitates the toner inside the toner accommodating chamber 18, some of the toner is supplied onto the supply roller 21 in the developing chamber 19. As the supply roller 21 rotates, the toner borne on the supply roller 21 is then supplied to the developing roller 22. At this time, the toner is positively tribocharged between the supply roller 21 and the developing roller 22. Subsequently, as the developing roller 22 rotates, the thickness-regulating blade 23 controls the thickness of a toner layer formed on the developing roller 22. The toner is thus carried on the circumferential surface of the developing roller 22 as a thin layer of uniform thickness.

Meanwhile, as the photosensitive drum 14 rotates, the Scorotron charger 15 charges the surface of the photosensitive drum 14 with a uniform positive polarity. The laser beam emitted from the scanner unit 9 selectively irradiates the positively charged surface of the photosensitive drum 14, thereby forming an electrostatic latent image thereon according to the image data.

As the photosensitive drum 14 continues to rotate, the positively charged toner borne on the surface of the developing roller 22 comes into contact with the photosensitive drum 14, thereby supplying the toner to the electrostatic latent image formed on the surface of the photosensitive drum 14. In this way, the latent image on the photosensitive drum 14 is developed into a visible toner image. Finally, the toner image is transferred onto the sheet P that has been conveyed to a transferring position, that is, between the photosensitive drum 14 and the transfer roller 16.

The fixing unit 11 is disposed in the main casing 2, rearward of the process cartridge 10. The fixing unit 11 includes a heat roller 24, a pressure pad 25 disposed in opposition to the heat roller 24 and an endless fixing belt 26. The fixing belt 26 is looped around the pressure pad 25, while being nipped between the heat roller 24 and the pressure pad 25. The pressure pad 25 presses the fixing belt 26 against the heat roller 24 from the bottom thereof.

The sheet P is conveyed to the fixing unit 11 after the toner image has been transferred thereon. In the fixing unit 11, as the sheet P passes between the heat roller 24 and the fixing belt 26, the sheet P comes into contact with the heat roller 24 and the fixing belt 26, and the toner image borne on the sheet P is fixed to the surface of the sheet P by the heat applied from the heat roller 24 and by the pressure applied from the pressure pad 25.

After the toner image has been fixed to sheet P in the fixing unit 11, the sheet P is then conveyed toward a pair of discharge rollers 27. The discharge rollers 27 discharge the sheet P onto a discharge tray 28, which is formed in the upper surface of the main casing 2.

Next, details of the fixing unit 11 will be described with reference to FIGS. 2 to 4. Note that a belt guide (described later) is omitted in FIG. 2.

In addition to the above-mentioned heat roller 24, the pressure pad 25, and the fixing belt 26, the fixing unit 11 further includes a supporting assembly 31 for supporting the pressure pad 25, and a tension spring 32 for urging the supporting assembly 31.

The heat roller 24 is configured of a substantially cylindrically-shaped metal tube that extends in a left-to-right (width) direction. The surface of the tube is coated with a layer of fluorine resin and the like.

More specifically, the heat roller 24 includes a fixing area 33 and side sections 34 at both axial end portions of the heat roller 24 for interposing the fixing area 33 therebetween. The width of the fixing area 33 is designed to be slightly greater than the maximum width of a sheet on which the laser printer 1 can form an image. The both side sections 34 are rotatably supported via bearing members (not shown). A gear (not shown) is fixedly coupled to the left side section 24.

The heat roller 24 accommodates a rod-like heating source 30 configured of a halogen lamp. The heating source 30 extends in the left-to-right direction and is arranged along the axial direction of the heat roller 24.

The pressure pad 25 includes a pad member 35 and a pad frame 36 that supports the pad member 35. The pad member 35 is formed of an elastic material such as rubber. The pad member 35 extends in the left-to-right direction as shown in FIG. 2, and has a substantially rectangular cross-section in which a length in the front-to-rear direction is greater than its height, as shown in FIG. 3.

Figure 2:
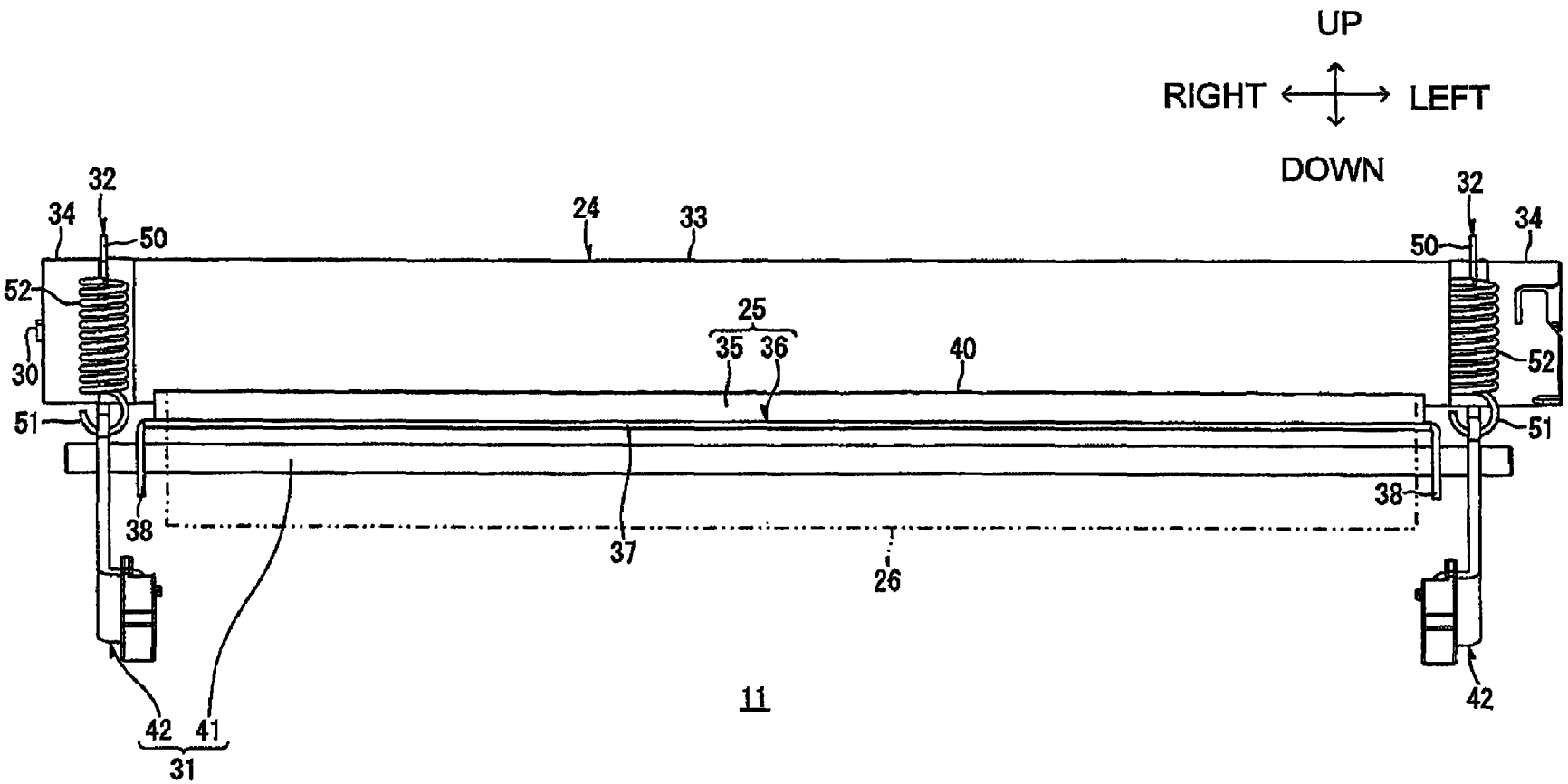
FIG. 2 is a rear view of the fixing unit shown in FIG. 1.

More specifically, the pad member 35 has a length is made slightly shorter than that of the fixing area 33 with respect to the left-to-right direction as shown in FIG. 2. Also, as shown in FIG. 3, the pad member 35 has an upper surface forming a substantially arcuate pressure surface 40, which is concave downward following the circumferential surface of the heat roller 24.

The pad frame 36 is formed by bending a flat metal plate, and includes a mounting portion 37 and holding portions 38. On the mounting portion 37 the pad member 35 is fixed and the holding portions 38 are fixed to a shaft member 41 (described later) as shown in FIG. 2. The mounting portion 37 and the holding portions 38 are integral with each other.

The mounting portion 37 is flat plate-shaped, and has a length in the left-to-right direction substantially the same as the length of the fixing area 33 of the heat roller 24, while being slightly longer than the length of the pad member 35 in the left-to-right direction. The mounting portion 37 has an upper surface on which the bottom surface of the pad member 35 is fixed.

Each of the holding portions 38 is formed by bending the metal plate downward at both ends thereof in the left-to-right direction. As shown in FIG. 4, each holding portion 38 has a substantially rectangular shape in a side view, and has a length in the front-to-rear direction slightly shorter than that of the mounting portion 37.

Also, each of the holding portions 38 has a fixing hole 39 in a central region thereof in a side view. Each fixing hole 39 is provided to allow a shaft member 41 (described later) to extend therethrough and to allow the shaft member 41 to be fixed thereto.

The supporting assembly 31 includes the shaft member 41 for supporting the pressure pad 25, and arm members 42 for supporting the shaft member 41, as shown in FIG. 2.

The shaft member 41 has a cylindrical shape extending in the left-to-right direction. The shaft member 41 has a length in the left-to-right direction longer than the length of the fixing area 33 of the heat roller 24, but shorter than the length between both axial end faces of the side sections 34 in the left-to-right direction. The shaft member 41 is disposed below the mounting portion 37 and extends in a longitudinal direction of the mounting portion 37 (i.e., the left-to-right direction).

The shaft member 41 penetrates the fixing holes 39 of the holding portions 38 so as to be incapable of rotating relative to the holding portions 38, thereby enabling the pad frame 36 to be fixed to the shaft member 41.

Each of the arm members 42 is disposed respectively below each side section 34 of the heat roller 24. The arm members 42 are formed of a metal plate. As shown in FIG. 3, each arm member 42 has a substantially rectangular plate shape in a side view, extending from diagonally upward front to diagonally downward rear. In a middle portion of the arm members 42 with respect to the front-to-rear direction, engaging sections 43 are formed. The engaging sections 43 protrude rearward from the arm members 42 and are substantially triangular-shaped in a side view. Each arm member 42 has a front end formed with a notch 44 that are cut out from the arm member 42 in a substantially circular shape in a direction extending from the front end to rearward thereof.

At the base end of each engaging section 43, i.e., at the central region of each arm member 42 with respect to the front-to-rear direction, a circular-shaped through-hole 45 is formed for allowing the shaft member 41 to extend therethrough. The shaft member 41 is rotatable with respect to the through-holes 45 of both arm members 42. At the rear end of each engaging section 43, a hook 46 is provided for engaging the tension spring 32. The hook 46 protrudes downward from the engaging section 43 at the rear end thereof.

The right and left arm members 42 are disposed below the respective side sections 34 of the heat roller 24 as shown in FIG. 2. A stationary supporting shaft 48 is provided in the main casing 2 and extends in the left-to-right direction thereof. The supporting shaft 48 rotatably extends through the notches 44 as shown in FIG. 3.

Therefore, both arm members 42 are pivotably movably supported to the main casing 2 via the supporting shaft 48. Further, both axial end portions of the pressure pad 25 are pivotably movably supported to the arm members 42. More specifically, the pressure pad 25 is pivotably movable about an axis of the shaft member 41.

Figure 4:
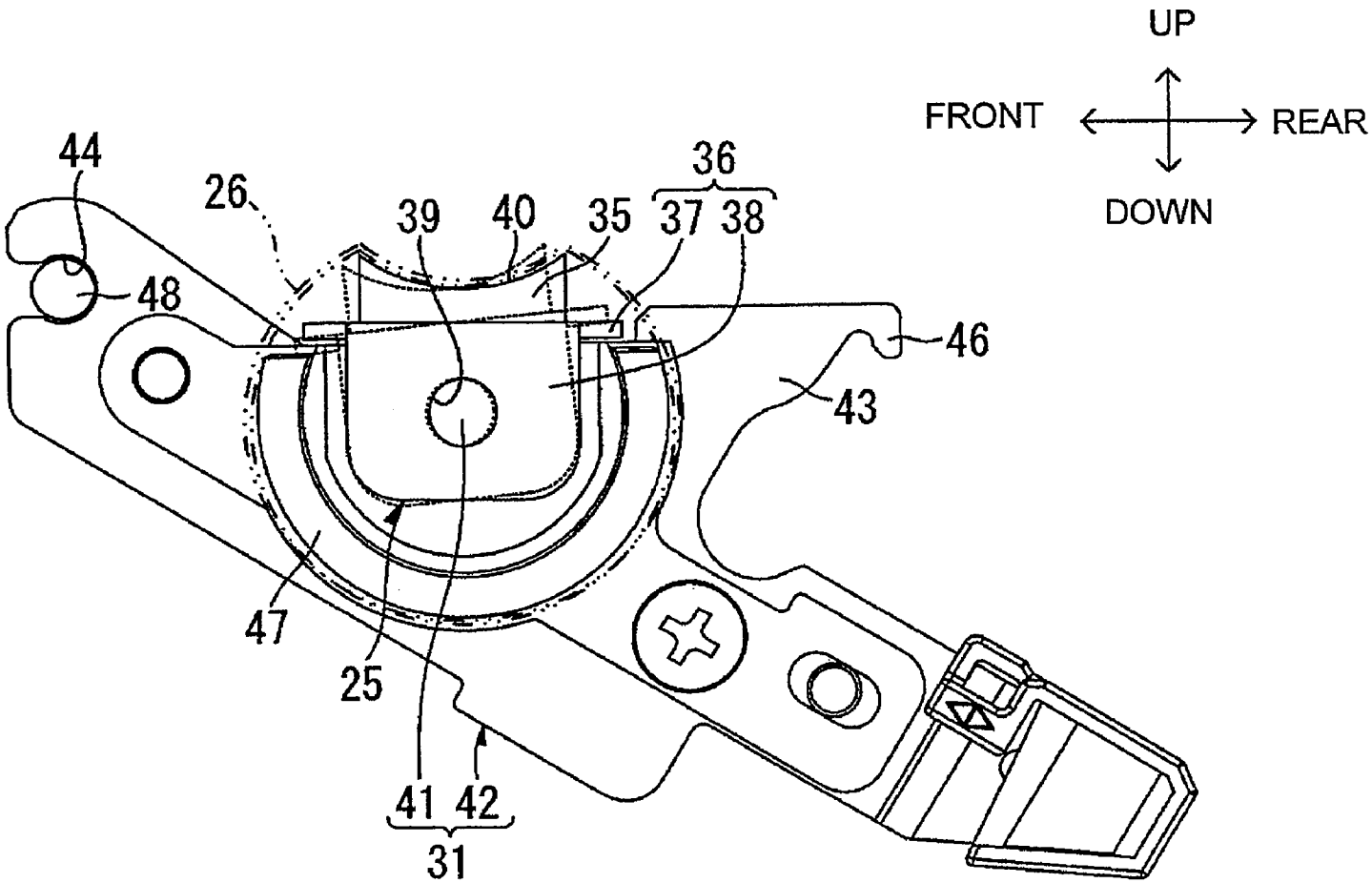
FIG. 4 is a right side view of an essential portion of the fixing unit shown in FIG. 1.

As shown in FIG. 4, a belt guide 47 is provided on each inner side surface of the arm members 42 in the left-to-right direction. The belt guide 47 is adapted for regulating running range of the fixing belt 26 over the pressure pad 25 as described later.

The belt guide 47 protrudes inward from the each inner side surface of the arm members 42 in the left-to-right direction to an extent that each belt guide 47 overlaps the widthwise end areas of the fixing belt 26. In a side view, the belt guide 47 is generally circular-shaped, surrounding the holding portion 38. Each belt guide 47 has an upper end surface disposed in opposition to both widthwise ends of the mounting portion 37 with a space therebetween with respect to an up-down direction. That is, each upper end of the guide 47 and each end of the mounting portion 37 in the left-to-right direction are arranged so as to keep a space therebetween within which a pivotal movement of the pressure pad 25 about the axis of the shaft member 41 can be performed.

When the pressure pad 25 pivots about the axis of the shaft member 41, the widthwise ends of the mounting portion 37 become in contact with the upper ends of the belt guides 47 as shown in by a dotted line in FIG. 4, thereby restricting further pivotal movement of the pressure pad 25. In other words, the belt guide 47 functions to restrict the pivotally movable range of the pressure pad 25 about the axis of the shaft member 41 as well as to regulate the circularly moving range (i.e., guide the running track) of the fixing belt 26.

The tension spring 32 is provided on each of the arm members 42 as shown in FIG. 2. The tension spring 32 includes an upper hook portion 50, a bottom hook portion 51, and a coil spring portion 52 provided therebetween.

Each tension spring 32 is disposed above the arm members 42 and the belt guide 47. The upper hook portion 50 is fixed to the main casing 2, while the bottom hook portion 51 is engaged with the hook 46.

The tension springs 32 urge the arm members 42 so that the hooks 46 can be pulled upward, and thus the rear ends of the arm members 42 are urged to move upward while the front ends thereof pivot about the supporting shaft 48. As a result, the pressure pad 25 supported by the arm members 42 is brought into pressure contact with the heat roller 24.

Figure 3:
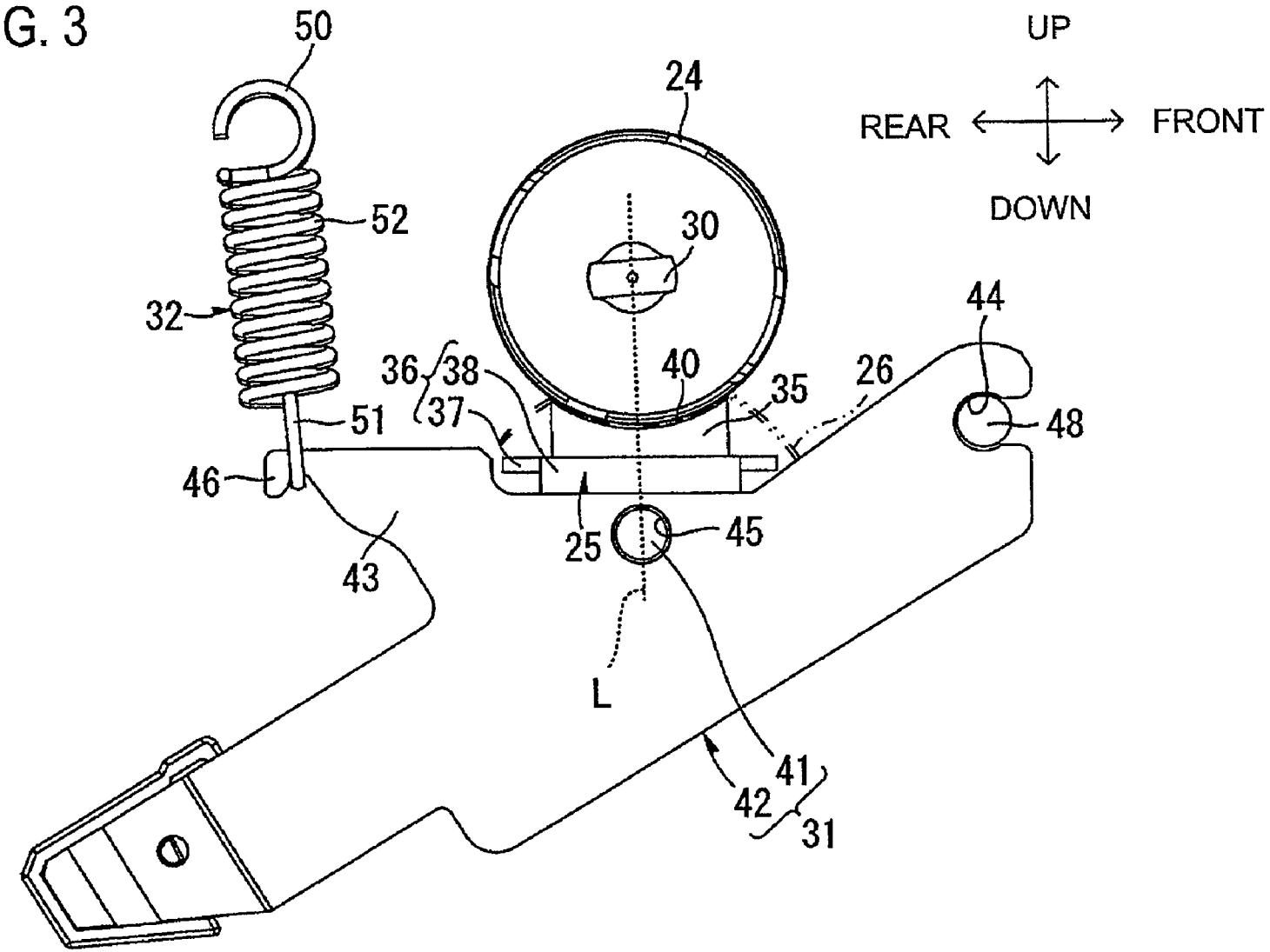
FIG. 3 is a left side view of the fixing unit shown in FIG. 1.

At this time, as shown in FIG. 3, the pressure pad 25 presses the heat roller 24 in a direction parallel to a line L passing through the center of the heat roller 24 and the rotational axis of the shaft member 41.

The fixing belt 26 is an endless belt extending along the left-to-right direction and formed of an elastic material, such as rubber, as shown by two dotted chain lines in FIG. 2 and FIG. 4. The fixing belt 26 passes between the pressure surface 40 of the pad member 35 and the heat roller 24, and is looped around the pressure pad 25 and the belt guide 47, as shown by the two dotted chain line in FIG. 4. The pressure pad 25 and the belt guide 47 are thus disposed inside the running track of the fixing belt 26. In other words, the fixing belt 26 is circularly movable over the pressure pad 25 and the belt guide 47.

The length of the fixing belt 26 with respect to the left-to-right direction is set to be shorter than the length of the pad member 35. The circumferential length of the endless fixing belt 26 is determined so that tension can be applied to the fixing belt 26 when the latter is disposed over the pressure pad 25 and the belt guide 47.

Next, operation in the fixing unit 11 will be described. First, the heating source 30 located inside the heat roller 24 generates heat by the power supplied from a power circuit board (not shown) provided in the main casing 2 for heating the heat roller 24. Further, a motor (not shown) provided in the main casing 2 transmits a driving force to the gear of the heat roller 24, causing the heat roller 24 to rotate. As the heat roller 24 rotates, the fixing belt 26 follows the movement of the heat roller 24 and slidingly moves over the pressure surface 40 of the pad member 35, thereby circularly moving around the pressure pad 25 and the belt guide 47.

The sheet P becomes in contact with the heat roller 24 and the fixing belt 26 when the sheet P passes therebetween. Meanwhile, the heat roller 24 applies heat while the pressure pad 25 applied pressure to the sheet P, thereby enabling the toner image to be fixed onto the sheet P.

Figure 5A:
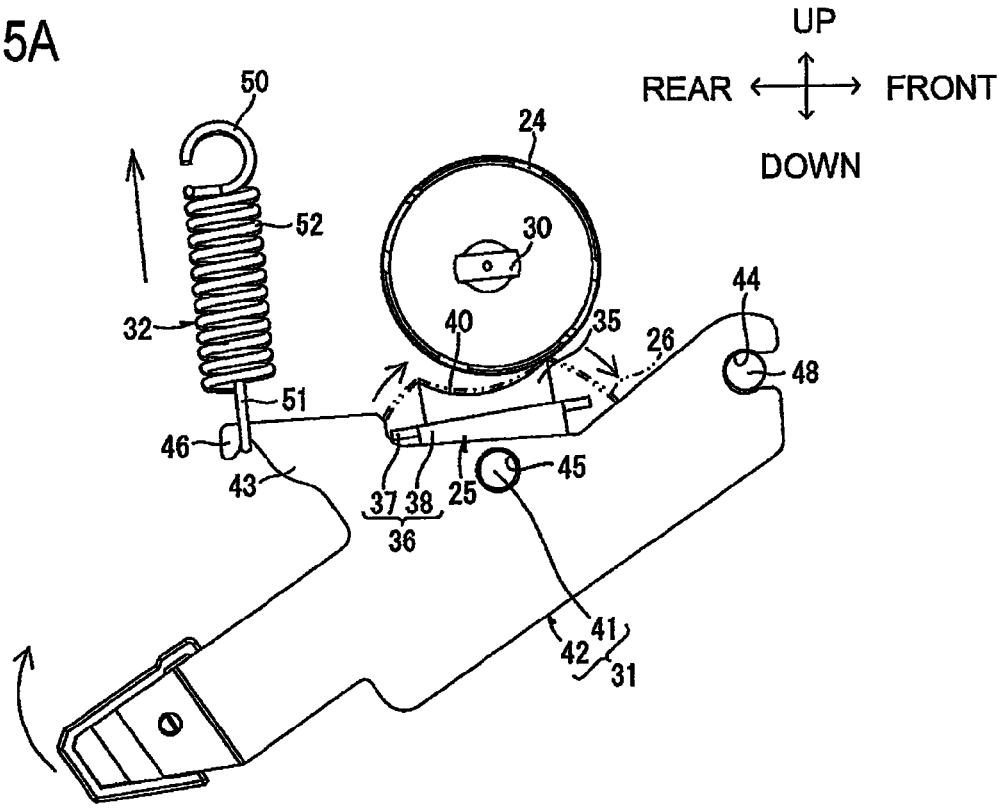
FIG. 5A shows a state where the pressure pad is brought into contact with the heat roller.
Figure 5B:
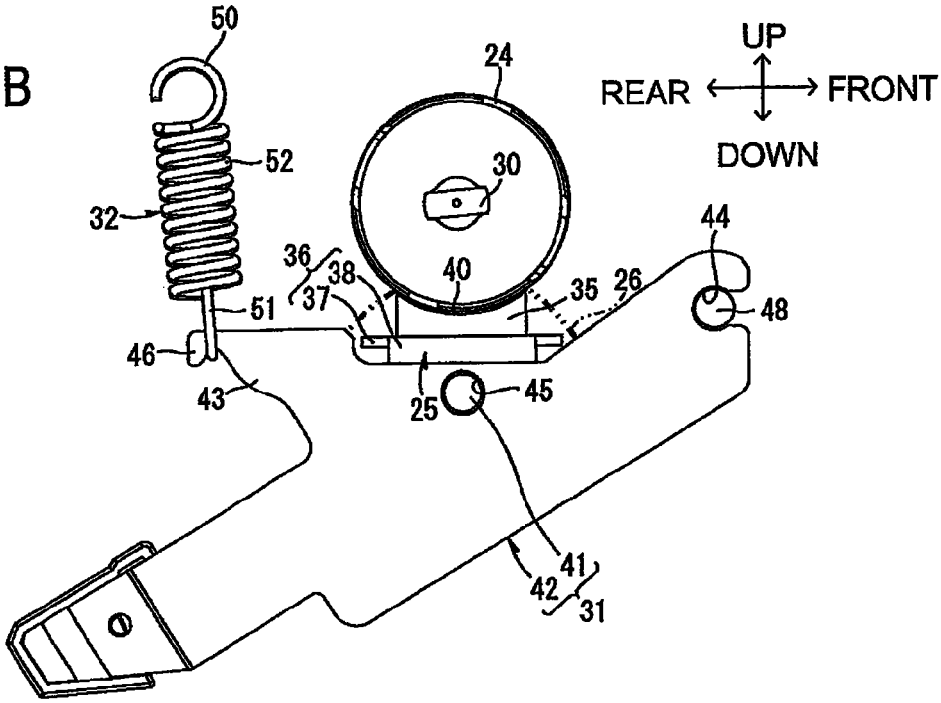
FIG. 5B shows a state where the pressure pad is tightly in contact with the heat roller.

Next, pressing manner of the pressure pad 25 against the heat roller 24 will be described with reference to FIGS. 5A and 5B. As shown in FIG. 5A, as the tension springs 32 urge the arm members 42, the rear ends of the arm members 42 are urged to move upward while the arm members 42 pivot about the supporting shaft 48.

Hence, since the pressure pad 25 is supported on the arm members 42, the front end of the pressure pad 25 first contacts the heat roller 24. Then, as the pressure pad 25 presses the heat roller 24, the pressure pad 25 is urged to pivot about the axis of the shaft member 41 in clockwise direction when seen from the left side, so that the pressure surface 40 of the pressure pad 25 can come into close contact with the circumferential surface of the heat roller 24. Thus, the pressure pad 25 is tightly pressed against the heat roller 24 so that the pressure surface 40 can be in close contact with the circumferential surface of the heat roller 24 via the fixing belt 26.

Hence, close contact between the pressure pad 25 and the heat roller 24 can be provided without accurate assembly of the pressure pad 25 relative to the heat roller 24. As a result, the fixing unit 11 can realize reduced accuracy in each component and easy assembly with a simple structure, while achieving a close contact between the pressure pad 25 and the heat roller 24.

Further, the shaft member 41 of the supporting assembly 31 supports the holding portions 38 disposed at the longitudinal ends of the pressure pad 25. Hence, in the fixing unit 11, the supporting assembly 31 can uniformly support the pressure pad 25 in the longitudinal direction thereof. As a result, the pressure pad 25 can be reliably pressed against the heat roller 24 along the longitudinal direction of the pressure pad 25.

Further, the pressure pad 25 is pressed against the heat roller 24 in a direction parallel to the line L that connects the axis of the shaft member 41 and the axis of the heat roller 24 in the radial direction of the shaft member 41. That is, the direction in which the pressure pad 25 is pressed against the heat roller 24 by the supporting assembly 31 is approximately the same as the direction in which the pressure pad 25 applies pressure to the heat roller 24.

Accordingly, the pressure pad 25 can press the heat roller 24 in the direction parallel to the line L from the time when one end of the pressure pad 25 makes a first contact with the heat roller 24. As a result, the pressure pad 25 can be pressed against the heat roller 24 in a reliable and efficient manner without making a large pivotal movement. Also, the urging force of the tension spring 32 can be efficiently converted into the pressure that the pressure pad 25 applies to the heat roller 24.

Further, the belt guide 47 regulates the circulation movement of the fixing belt 26 concurrently with restricting the pivotal movement of the pressure pad 25. Hence, the direction in which the pressure pad 25 presses the heat roller 24 can also be regulated by the belt guide 47. That is, restriction by the belt guide 47 enables the pressure surface 40 of the pressure pad 25 to face toward the heat roller 24. As a result, the pressure pad 25 can stably and tightly contact the heat roller 25. Another restricting member is thus not necessary to be prepared for restricting the pivotal movement of the pressure pad 25, thereby contributing to reduction in the number of parts and simplification of the device configuration.

Moreover, the shaft member 41 rotatably penetrates the through-holes 45 of the arm members 42. Hence, the axis of the shaft member 41 becomes a pivotal axis of the pressure pad 25, achieving accurate positioning of the pivotal center of the pressure pad 25. The pressure pad 25 can, therefore, be made in close contact with the heat roller 24.

Instead of the tension spring 32, a compression spring may be employed for achieving a close contact between the pressure pad 25 and the heat roller 24. In the latter case, the compression spring is provided at a side opposite to the heat roller 24 with respect to the arm member 42. However, controlling the expanding direction of the compression spring is generally more difficult than controlling the shrinking direction of the tension spring 32. Therefore, in this fixing unit 11, a tensile force of the tension spring 32 is employed for pressing the pressure pad 25 against the heat roller 24, enabling a more stable pressure contact therebetween to be realized.

Since the laser printer 1 is provided with the above-described fixing unit 11, the laser printer 1 can realize improved productivity, reduction in production costs as well as efficient fixation of a toner image.

As a variation of the first embodiment, the belt guide 47 may be spanned between the arm members 42 so as to extend along the full length of the fixing belt 26.

Figure 6:
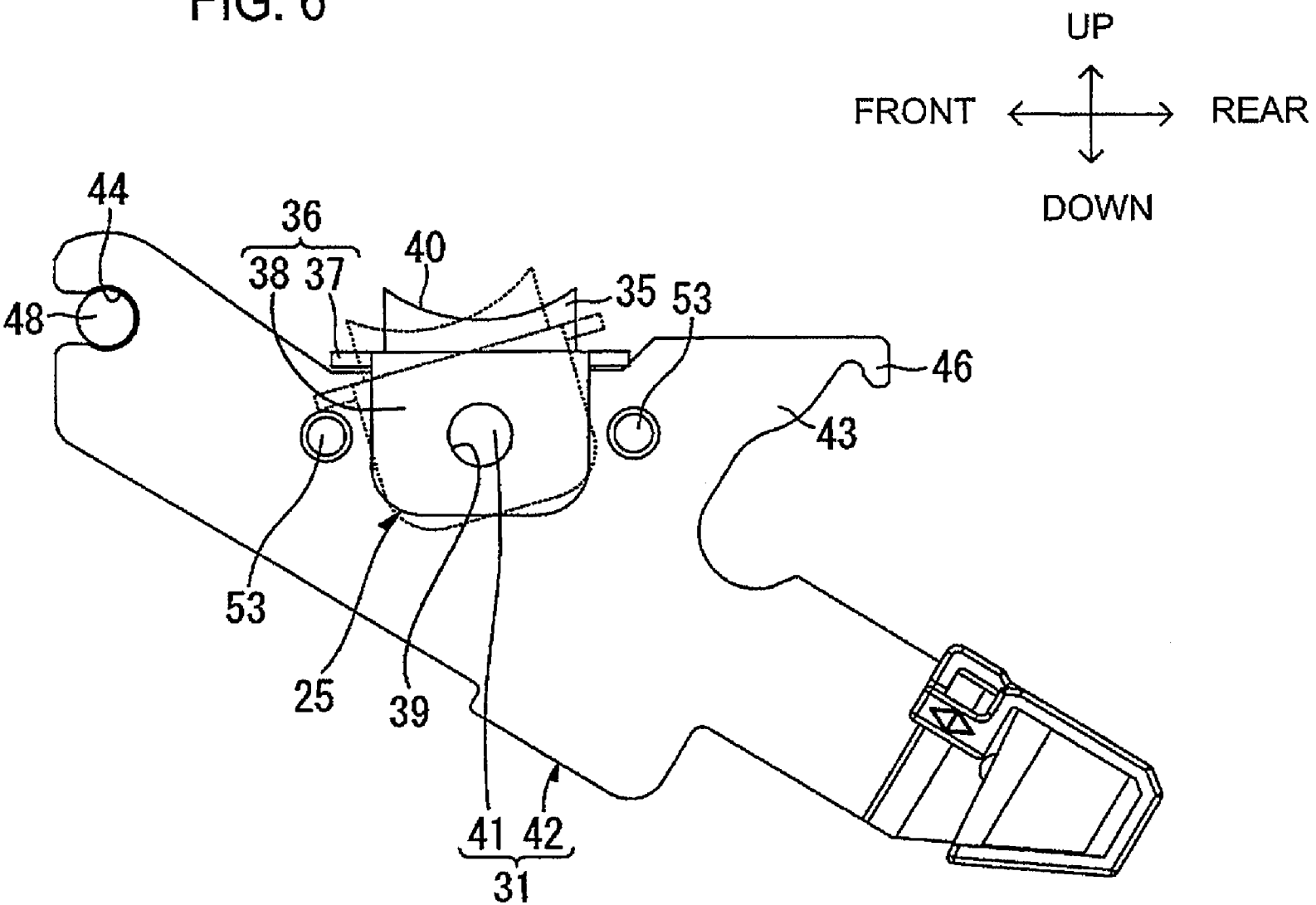
FIG. 6 is a right side view of an essential portion of the fixing unit according to a second embodiment of the present invention.

Next, a fixing unit according to a second embodiment of the present invention will be described with reference to FIG. 6. In FIG. 6, like parts and components are designated by the same reference numerals as those shown in FIG. 4 in order to avoid duplicating description.

In the first embodiment, the belt guide 47 provided on the inner surface of the arm members 42 with respect to the left-to-right direction serves as the restricting member that restricts pivotal movement of the pressure pad 25. In the second embodiment, each arm member 42 is provided with ribs 53, instead of the belt guide 47, for restricting the pivotal movement of the pressure pad 25. A fixing belt and a belt guide may be additionally employed, but not necessarily be provided in the second embodiment.

The ribs 53 protrude inward with respect to the widthwise direction from the inner side surface of the arm members 42 so that the holding portion 38 be disposed between the ribs 53 in the front-to-rear direction in a side view. More specifically, the ribs 53 are substantially columnar shaped. The ribs 53 are disposed in opposition to the widthwise ends of the mounting portion 37 with a space therebetween in the up-down (vertical) direction so that the pressure pad 25 can pivotally move within the space.

With this construction, when the pressure pad 25 pivots about the axis of the shaft member 41, a front end of the mounting portion 37 gets in contact with one of the ribs 53 as shown in FIG. 6, thereby limiting further pivotal movement of the pressure pad 25. The ribs 53 can thus control the direction in which the pressure pad 25 is pressed against the heat roller 24. In other words, the pressure surface 40 of the pressure pad 25 can be directed to the heat roller 24. As a result, the pressure pad 25 can reliably be in close contact with the heat roller 24.

While the invention has been described in detail with reference to specific embodiments thereof, it would be apparent to those skilled in the art that many modifications and variations may be made therein without departing from the spirit of the invention, the scope of which is defined by the attached claims.

What is claimed is:

1. A thermal fixing unit configured to fix a toner image on a printing medium, the fixing unit comprising:

a heat member configured to be in contact with the printing medium and defining an axis, the heat member being positionally fixed and including a heat roller rotatable about the axis defined by the heat member;

a pressure pad disposed in opposition to the heat member, wherein the pressure pad is configured to nip the printing medium in cooperation with the heat member;

a movable supporting assembly configured to pivotably movably support the pressure pad, the supporting assembly comprising:

a mount portion disposed along a length of the pressure pad and having a shaft member defining an axis, the pressure pad being fixed to the mount portion, and an arm portion pivotably movable toward and away from the heat roller, the arm portion configured to pivotably movably support the mount portion about the axis defined by the shaft member; and an urging member configured to connect to the arm portion and to bias the supporting assembly to urge the pressure pad toward the heat member for providing pressure contact between the heat member and the pressure pad, wherein the heat roller, the pressure pad, the mount portion and the arm portion are positioned in a geometrical relationship such that the pressure pad is pressable against the heat roller in a direction parallel to a line passing through the axis defined by the shaft member and the axis defined by the heat roller.

2. The fixing unit according to claim 1, wherein the pressure pad has axial end portions, and wherein the supporting assembly is configured to support the axial end portions.

3. The fixing unit according to claim 1, further comprising a restriction portion configured to restrict a pivotally movable range of the pressure pad about the axis defined by the shaft member.

4. The fixing unit according to claim 3, wherein the restriction portion is provided at the arm portion.

5. The fixing unit according to claim 4 wherein the pressure pad has a pressure surface having a shape conforming to a curvature of the heat roller, and wherein the fixing unit further comprises:

an endless belt member disposed over the pressure surface, the endless belt being configured to directly contact the printing medium and slidingly move over the pressure surface during pressure contact between the heat roller and the pressure surface in association with the rotation of the heat roller; and a belt guide provided at the arm portion, the belt guide having a first portion functioning as a belt guide that defines a running track of the endless belt in cooperation with the pressure surface for regulating a running direction of the endless belt, the belt guide further having a second portion functioning as the restricting portion.

6. The fixing unit according to claim 4, wherein the restriction portion comprises a rib.

7. The fixing unit according to claim 1, wherein the shaft member is configured to rotatably extend thorough the arm portion.

8. The fixing unit according to claim 1, wherein the urging member comprises a tension spring.

9. An image forming device having a thermal fixing unit configured to fix a toner image on a printing medium, the fixing unit comprising:

a heat member configured to be in contact with the printing medium and defining an axis, the heat member being positionally fixed and including a heat roller rotatable about the axis defined by the heat member;

a pressure pad disposed in opposition to the heat member, wherein the pressure pad is configured to nip the printing medium in cooperation with the heat member;

a movable supporting assembly configured to pivotably movably support the pressure pad, the supporting assembly comprising:

a mount portion disposed along a length of the pressure pad and having a shaft member defining an axis, the pressure pad being fixed to the mount portion, and an arm portion pivotably movable toward and away from the heat roller, the arm portion configured to pivotably movably support the mount portion about the axis defined by the shaft member; and an urging member configured to connect to the arm portion and to bias the supporting assembly to urge the pressure pad toward the heat member for providing pressure contact between the heat member and the pressure pad, wherein the heat roller, the pressure pad, the mount portion and the arm portion are positioned in a geometrical relationship such that the pressure pad is pressable against the heat roller in a direction parallel to a line passing through the axis defined by the shaft member and the axis defined by the heat roller.

10. The image forming device as claimed in claim 9, further comprising a casing in which the thermal fixing unit is installed, wherein the heat member is rotatably supported to the casing, wherein the movable supporting assembly is pivotably movably supported to the casing, and wherein the urging member is interposed between the casing and the movable supporting assembly.

* * * * *